US005715510A

United States Patent [19]

Kusaba et al.

[11] Patent Number: 5,715,510

[45] Date of Patent: Feb. 3, 1998

[54] IMAGE FORMING APPARATUS HAVING AN INTERMEDIATE TRANSFER MEMBER AND METHOD OF FORMING OF IMAGE USING THE TRANSFER MEMBER

[75] Inventors: Takashi Kusaba, Kawasaki; Hiroyuki Kobayashi, Fuji; Akihiko Nakazawa, Kanagawa-ken; Atsushi Tanaka; Tsunenori Ashibe, both of Yokohama, all of Japan

[73] Assignee: Canon Kabushiki Kaisha, Tokyo, Japan

[21] Appl. No.: 561,416

[22] Filed: Nov. 21, 1995

[30] Foreign Application Priority Data

Nov. 28, 1994 [JP] Japan ..... 6-293198
Dec. 6, 1994 [JP] Japan ..... 6-301855

[51] Int. Cl.[6] ..... G03G 15/16

[52] U.S. Cl. ..... 399/308; 399/302; 430/126

[58] Field of Search ..... 355/271, 272, 355/274; 430/126; 399/302, 308

[56] References Cited

U.S. PATENT DOCUMENTS

| | | | |
|---|---|---|---|
| 3,975,352 | 8/1976 | Yoerger et al. | 524/462 |
| 5,084,735 | 1/1992 | Rimai et al. | 355/271 |

FOREIGN PATENT DOCUMENTS

| | | |
|---|---|---|
| 0453762 | 10/1991 | European Pat. Off. . |
| 0495668 | 7/1992 | European Pat. Off. . |
| 0617345 | 9/1994 | European Pat. Off. . |
| 62-223757 | 1/1987 | Japan . |
| 63-301960 | 12/1988 | Japan . |
| 3-242667 | 10/1991 | Japan . |
| 4-81786 | 3/1992 | Japan . |
| 4-88385 | 3/1992 | Japan . |
| 5-333725 | 12/1993 | Japan . |
| 6-93175 | 4/1994 | Japan . |
| 6-95517 | 4/1994 | Japan . |
| 6167817 | 6/1994 | Japan . |

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

An image forming apparatus having a first image supporting member and an intermediate transfer member for transfer of an image from the first image supporting member and means for transferring the transferred image on the intermediate transfer member to a second image supporting member; characterized in that the contact angle between a surface of the intermediate transfer member and water is 60° or above, and the sliding resistance of the surface is 200 g or below. The above image forming apparatus has excellent durability and good image forming properties under overall environmental conditions, and produces images without toner-filming.

19 Claims, 4 Drawing Sheets

IMAGE FORMING APPARATUS HAVING AN INTERMEDIATE TRANSFER MEMBER AND METHOD OF FORMING OF IMAGE USING THE TRANSFER MEMBER

BACKGROUND OF THE INVENTION

1. Field of the Invention

The present invention relates to an image forming apparatus, particularly to an image forming apparatus having an intermediate transfer member. It also relates to a method of forming an image using apparatus as aforesaid.

2. Description of the Prior Art

In the formation of a coloured image by an electrographic process, an intermediate transfer member can be used to build-up a coloured image by successively receiving imaged components in the individual colours (e.g. of a magenta image, a cyan image or a yellow image) corresponding to the colour information of the original image. The individual colour components of the image can be formed in succession in the same position on the intermediate transfer member, and it is easy to arrange that there is no shift in position between the successive images.

FIG. 1 is a schematic side view of a colour image forming apparatus, for example, a copying machine or a laser beam printer. The apparatus in FIG. 1 has an intermediate transfer member 20 provided with an elastomeric surface, and an electrophotographic photosensitive member 1 (herein below referred to as "a photosensitive member") which is used as a first image supporting member. The photosensitive member 1 is rotatable about an axis at a prescribed surface speed (herein below referred to as "a process speed"). The surface of the photosensitive member 1 is uniformly charged by means of a primary charger 2 (e.g. a corona charger) to impart an electric charge having a prescribed polarity and potential. The photosensitive member 1 is then subjected to imagewise exposure with light 3 by an image exposure means (not shown) so that an electrostatic latent image corresponding to an image component of a first colour (e.g. a magenta image) is formed on the photosensitive member 1. Thereafter the electrostatic latent image is developed using a magenta toner by first development means 41 which contains a magenta coloured toner M. During this operation, a second development means 42 which contains a cyan toner C, a third development means 43 which contains a yellow toner Y and a fourth development means 44 which contains a black toner B are inoperative. Therefore the first magenta toner image is not disturbed by the second to fourth development means 42 to 44.

The intermediate transfer member 20 may comprise a cylindrical support 21 and an elastomeric layer 22 formed on the support 21. The intermediate transfer member is rotated in the direction of the arrow shown in FIG. 1 at the same surface speed as the photosensitive member 1. The image component of the first colour (i.e. the magenta image) on the photosensitive member 1 is transferred to the peripheral surface of the intermediate transfer member 20 by an electric field formed by the first transfer bias potential which is applied between the intermediate transfer member 20 and the photosensitive member 1. The peripheral surface of the photosensitive member 1 is cleaned by means of a cleaning means 14 after the magenta image has been transferred to the intermediate transfer member 20. A cyan image, a yellow image and a black image are then transferred in succession and in super-imposed relationship onto the intermediate transfer member 20 in the same manner as the magenta image so that the desired colour image is built up. The first transfer bias which brings about transfer of each image component of each colour is supplied by a bias power supply 61. The polarity of the first transfer bias is different from the polarity of the charge which is applied to the toner. The voltage applied by the bias power supply 61 is preferably in the range +2 Kv to +5 Kv.

The colour image on the intermediate member 20 is then transferred to a receiving medium 24 which is the second image supporting member. The receiving medium 24 which may be paper sheets, is conveyed from a feeder 9 to a nip which is defined between the intermediate transfer member 20 and a transfer roller 25, and a bias potential is applied to the transfer roller 25 from a bias power supply 29. After transfer of the colour image to the receiving medium 24 has taken place, the receiving medium is conducted to a fixing station 15 at which the receiving medium is heated to fix the image. After transfer of the colour image has taken place, residual toner on the intermediate transfer member 20 is removed by means of a cleaning member 35.

A colour electrophotographic apparatus having the aforesaid intermediate transfer member is better than a colour electrophotographic apparatus which does not have the intermediate transfer member e.g., the apparatus described in Japanese Laid-Open Patent Application No. 63-301960 in the following respects:

(a) Image components of the various colours can be transferred to the intermediate transfer member without the positions of each colour image component being shifted relative to that of the others.

(b) In the case of a colour electrophotographic apparatus which does not use an intermediate transfer member, the second image supporting member is fixed on the photosensitive member, so that the second image supporting member has to be relatively thin. On the other hand, a colour electrophotographic apparatus using an intermediate transfer member does not require the second image supporting member to be fixed onto the photosensitive member, so that a variety of second image supporting members can be used. For example, both thin paper sheets (e.g. about 40 $g/m^2$) and thicker paper sheets (e.g. about 200 $g/m^2$) can be used as the second image supporting member. The second image supporting member can also be on a envelope, a postcard or a label.

However, when a electrophotographic apparatus using an intermediate transfer member is subjected to repeated use in bad environmental conditions, the following problems can arise:

(1) Transfer of the toner from the first image supporting member (e.g. a photosensitive member) to an intermediate member, and from the intermediate member to the second image supporting member (paper or overhead projector sheet) may take place with insufficient efficiency. As a result, a cleaning device has to be provided both for the photosensitive member and for the intermediate transfer member. Cleaning devices bring about wear of the photosensitive member and the intermediate transfer member, and tend to reduce the life of these members. Furthermore, a cleaning device has a relatively complex structure and can increase cost.

(2) As shown in FIG. 6, image transfer to the intermediate member or to the second image supporting member may take place incompletely (hereinafter referred to as "a hollow image"). The hollow image can be caused by insufficient efficiency of the transfer as described in paragraph (1) above. The transfer efficiency can be affected by the surface characteristics or electrical resistance of the intermediate transfer member, by the bias voltage applied at the time of image transfer, and by the timing of the bias voltage. The main reasons for insufficient transfer efficiency have not been identified. However, it is known that the transfer efficiency is reduced under the following circumstances:

(a) where the apparatus has been subjected to prolonged use;

(b) where the apparatus is used in low temperature or low humidity environmental conditions.

(3) Although, as shown in FIG. 1, a cleaning member 35 is provided for cleaning residual toner on the intermediate transfer member, after the cycle of toner transfer and cleaning has been repeated for a few thousand times or for a few tens of thousands of times, a deposit of toner which is not removed forms gradually on the surface of the intermediate transfer member. As a result there is formed a toner film, and since the transfer efficiency of the toner is made worse by the formation of a toner film, partial images can be formed. It is known from Japanese Laid-Open Patent Application No. 6-95517 that formation of toner films can be prevented by using a surface which has a large contact angle. However, surfaces having a large contact angle can be tacky.

(4) The intermediate transfer member can have a layer of rubber, resin or other elastomeric material. Japanese Laid-Open Patent Application No. 4-81786, 4-88385, 3-242667 and 5-333725 disclose preferred materials for use in such an elastomeric layer. However, there is no material which provides adequate performance over a full range of environmental conditions, including both conditions of low temperature and low humidity and conditions of high temperature and high humidity.

SUMMARY OF THE INVENTION

In one aspect the present invention provides an intermediate transfer member for an electrophotographic image forming apparatus, characterized in that the contact angle between a surface of the intermediate transfer member and water is 60° or above, and the sliding resistance of said surface is 200 g or below.

The invention also provides an image forming apparatus comprising a first image supporting member, an intermediate transfer member for transfer of an image from the first image supporting member and means for transferring the transferred image on the intermediate transfer member to a second image supporting member, characterized in that the contact angle between a surface of the intermediate transfer member and water is 60° or above, and the sliding resistance of the surface is 200 g or below. The invention also relates to a method of forming an image using apparatus as aforesaid.

Embodiments of the above image forming apparatus can exhibit good durability and image forming properties under a wide range of environmental conditions, including low temperature, low humidity conditions and high temperature, high humidity conditions. The intermediate transfer member of the invention exhibits excellent transfer efficiency.

BRIEF DESCRIPTION OF THE DRAWINGS

How the invention may be put into effect will now be described, by way of example only, with reference to the accompanying drawings in which.

DETAILED DESCRIPTION OF THE INVENTION

In the following description "part(s)" and "%" means "weight part(s)" and "weight %" respectively.

The image forming apparatus of the present invention comprises a first image supporting member, an intermediate transfer member arranged to receive an image formed on the first image supporting member and means for transferring a transferred image on the intermediate transfer member to a second image supporting member. The apparatus is characterized in that the contact angle between the surface of the intermediate transfer member and water is 60° or above, and in that the sliding resistance of the surface is 200 g or below.

Toner can be separated easily from the surface of the intermediate transfer member used in the present invention. Therefore the image forming apparatus of the present invention can exhibit high transfer efficiency of toner, and good image forming properties. Furthermore, residual toner present on the intermediate transfer member can be cleaned using a light cleaning device, and wear of the intermediate member is therefore reduced and its life is prolonged.

The electrical resistance of the intermediate transfer member used in the present invention varies only slightly with environmental conditions. The reason is believed because of the hydrophobic nature of the intermediate transfer member. The absence of hydroscopic properties in that member is apparent from the contact angle between the surface of the intermediate transfer member and water which is required to be 60° or above.

Preferably the contact angle between the surface of the intermediate transfer member and water is 130° or below, and preferably its sliding resistance is 5 g or above. More preferably the contact angle is in the range from 70° to 120°, and the sliding resistance is in the range of 10 g to 150 g. If the contact angle is too large or the sliding resistance is too low, it may be difficult to support a toner image on the intermediate transfer member.

Contact angles can be measured by depositing on an aluminium sheet a layer of the same material as is intended to form the outermost layer of the intermediate transfer member, and then measuring the contact angle by means of a goniometer-type measuring instrument e.g., an instrument made by Kyowakaimen Kagaku Inc. Sliding resistance can be measured using a sample as described above by means of a Heidon-14DR surface character measuring instrument manufactured by Shinto Kagaku Inc. In the measurement of sliding resistance a plane pressure member of the surface character measuring instrument is covered with polyethylene terephthalate (PET), provides a load of 200 gf vertically towards the sample which is moved in a horizontal direction at a speed of 100 mm/min.

Figure 2:
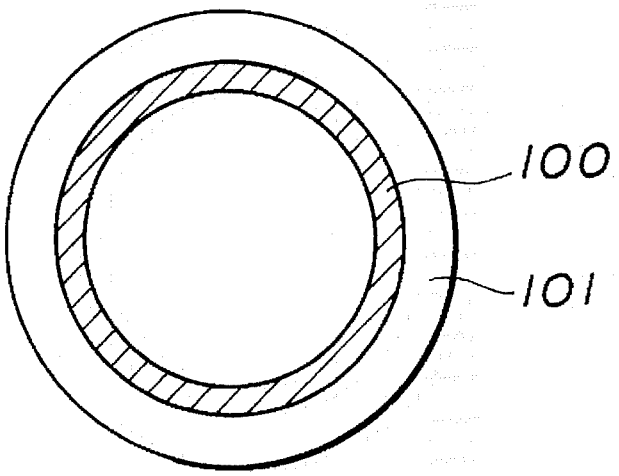
FIGS. 2, 3 and 4 are views in cross-section of an intermediate transfer member intended for use in the apparatus of FIG. 1, the transfer members in these figures differing in their covering.
Figure 3:
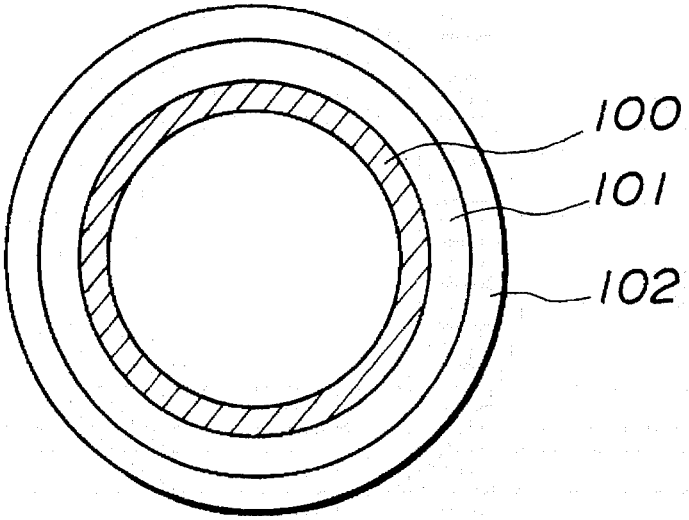
Figure 4:
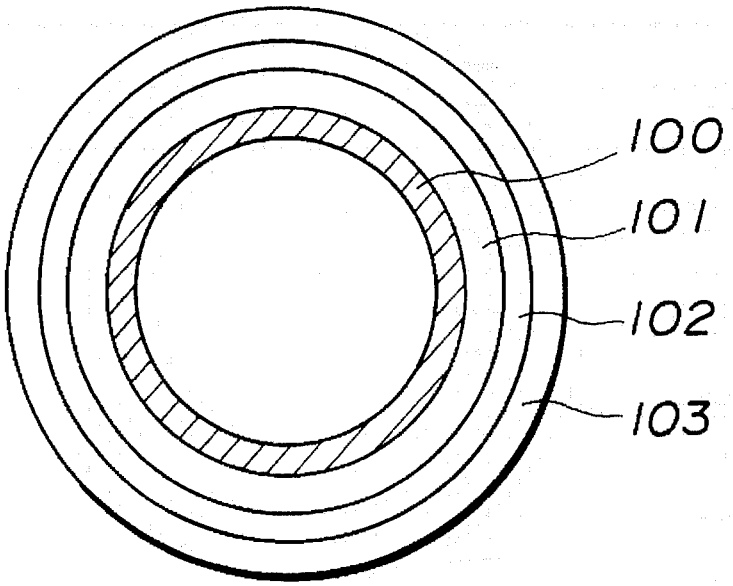
Figure 6:
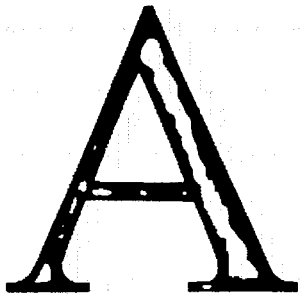
FIG. 6 is an illustration showing the formation of a hollow image.
Figure 5A:
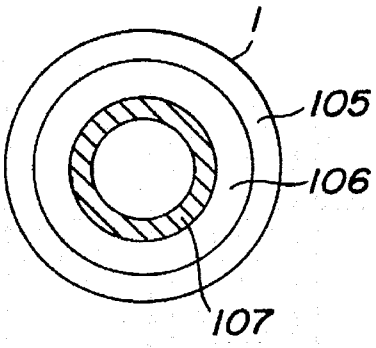
FIG. 5A is a cross-sectional view of a photosensitive member intended for use in the apparatus of FIG. 5.
Figure 5:
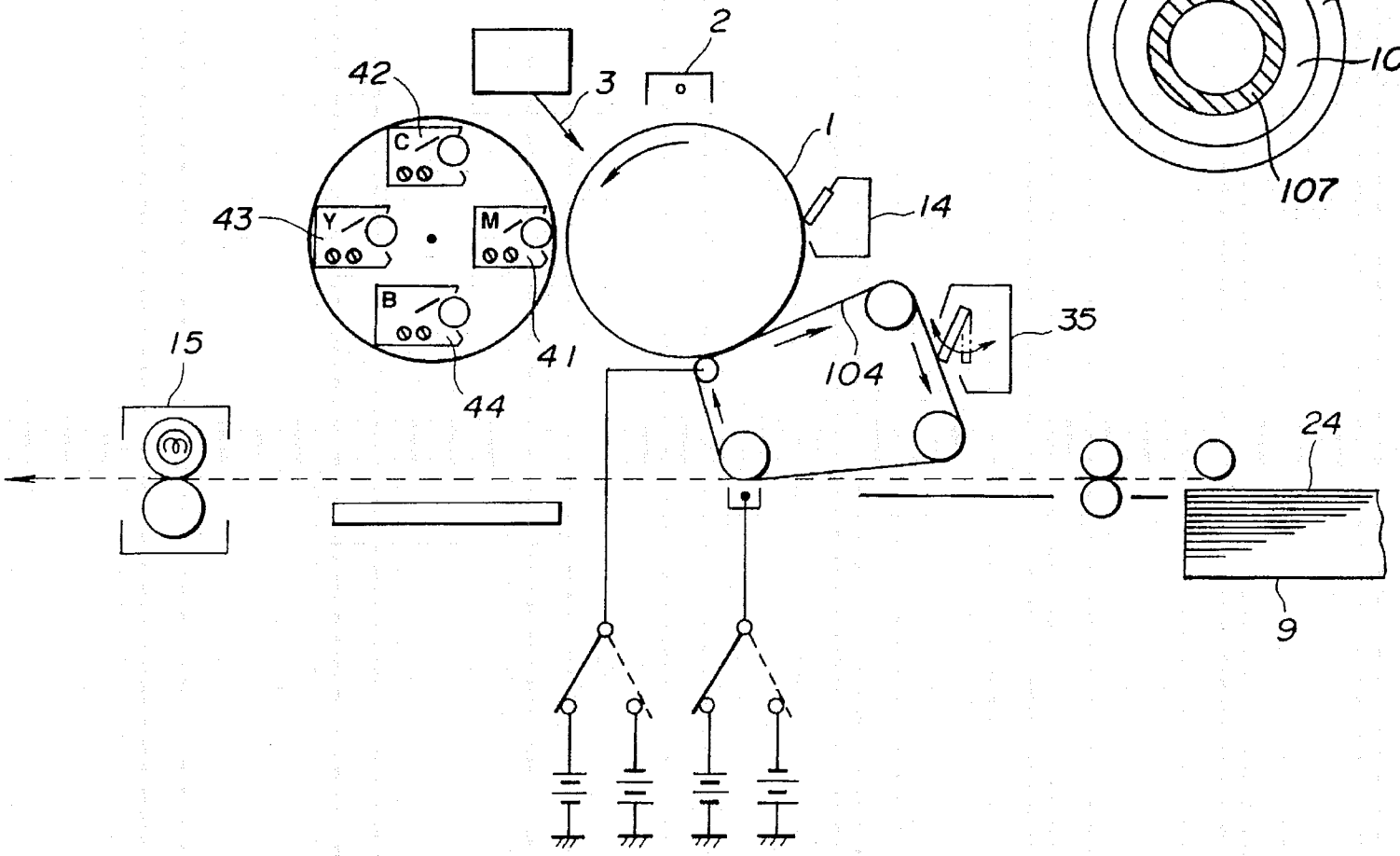
FIG. 5 is a diagrammatic side view of another embodiment of the image forming apparatus of the invention.

A plane pressure member is described in ASTM D-1894. Various intermediate transfer members can be used, for example an endless belt shaped intermediate transfer member as shown in FIG. 5 on a transfer member which comprises a cylindrical support, an elastic layer on the support and optionally one or more cover layers as shown in FIGS. 2–4. The electrical resistance and surface character of the intermediate transfer member can be adjusted when the cover layer is formed. A cylindrical intermediate transfer member is preferred from the standpoint of reduction in the shift in relative positions of the image components of the various colours, and from the standpoint of durability. The elastomeric layer is preferably of a rubber, another elastomeric material, or a resin. In FIGS. 2–5, 100 represents the cylindrical support, 101 represents an elastomeric layer, 102 and 103 represent cover layers and 104 represents an intermediate transfer member in the form of an endless belt. The cylindrical support 100 may be made of a conductive material which may be a metal or alloy, for example aluminium, aluminium alloys, iron, copper or stainless steel. It also may be made of a conductive resin containing carbon powder or metallic powder. Examples of the rubber, elastomer or resin which may be used in the elastomeric layer and the cover layer of the intermediate transfer member include styrene-butadiene rubber, butadiene rubber, isoprene rubber, an ethylene-propylene copolymer, acrylonitrile-butadiene rubber, chloroprene rubber, butyl rubber, silicone rubber, fluorocarbon rubber, nitrile rubber, urethane rubber, acrylic rubber, epichlorohydrin rubber, norbonene rubber, a styrene type resin (i.e. a homopolymer or copolymer including styrene or a substitution product of styrene), for example polystyrene, chloropolystyrene, poly-α-methlystyrene, styrene-butadiene copolymer, styrene-vinyl chloride copolymer, styrene-vinyl acetate copolymer, styrene-maleic acid copolymer, styrene acrylic ester copolymer, styrene-methyl acrylate copolymer, styrene-ethyl acrylate copolymer, styrene-butyl acrylate copolymer, styrene-octyl acrylate copolymer and styrene-phenyl acrylate copolymer, styrene-methacrylate copolymer, styrene-methyl methacrylate copolymer, styrene-ethyl methacrylate copolymer and styrene-phenyl methacrylate copolymer, styrene-alpha-chloromethyl acrylate copolymer, styrene-acrylonitrile-acrylic ester copolymer; vinyl chloride resin, resin-extended maleic acid resin, phenyl resin, epoxy resin, polyester resin, polyamide resin, polyethylene, polypropylene, ionomer resin, polyurethane resin, silicone resin, fluorocarbon resin, keton resin, ethylene-ethyl acrylate copolymer, xylene resin and polyvinyl butyryl. The above mentioned rubber, elastomer or resin material may be used singly or in combination of two or more of them.

The outermost layer advantageously contains a lubricious powder which may be an inorganic powder or an organic powder. Alternatively, it may contain a lubricant liquid such as silicone oil. The use of lubricant powder is preferred because lubricant powder does not damage the photosensitive member, and it has a good ability to adjust the lubricity of the intermediate transfer member. Furthermore, it produces good adhesion between each other lubricant powder or a layer containing it and another layer, since the layer also contains a binder resin.

The lubricity of the lubricant is measured as follows. A mixture of 20 parts lubricant, 100 part of a urethane prepolymer and five parts of curing agent is applied onto a polyethylene terephthalate (PET) plate by spray coating. The viscosity of the mixture can be adjusted by addition of toluene and methyl ethyl ketone. A comparative sample is prepared in the manner described above except that lubricant is not present. The sliding resistance of the sample containing lubricant and of the comparative sample are measured as described above. If the sliding resistance of the lubricant-containing sample is 80% or below of that of the comparative sample, the lubricant will exhibit desirable properties for the present purposes. Although the lubricant is not limited to the materials set out below, preferred examples are as follows:

Fluorocarbon rubber, fluorocarbon elastomers, fluorinated graphite, powders of organo-fluorine compounds such as polytetrafluoroethylene (PTFE) poly(vinylidenefluoride) (PVDF), ethylene-tetrafluoroethylene copolymer (ETFE), tetrafluoroethylene-perfluoro alkylvinyl ether copolymer (PFA), and powdered organosilicon compounds such as silicone resins, silicone rubbers and silicone elastomers, polyethylene (PE), polypropylene (PP), polystyrene (PS), acrylic resin, nylon resin, silica, alumina, titanium oxide and magnesium oxide. The above mentioned lubricants can be used individually or in combinations of two or more them.

The lubricant powder preferably has an average particle size of 0.02–50 μm from the standpoint of dispersibility of the lubricant and surface smoothness of the intermediate transfer member. If necessary, the surface of the lubricant particles can be treated with an agent which reduces damage to the lubricant. Furthermore, a dispersing agent can be used with the lubricant. The lubricant is preferably present in the outermost layer of the intermediate transfer member in an amount of 20–80% particularly 25–75%. If the content of lubricant is less than 20%, the intermediate transfer member may exhibit insufficient lubricity, and as a result toner-filming and decreasing of the second transfer efficiency are liable to take place. If the content of lubricant is more than 80%, the intermediate transfer member may exhibit poor durability because of decreasing adhesion between each other lubricant or the outermost layer and another layer.

In order to form the outermost layer of the intermediate transfer member, lubricant and resin, elastomer or rubber are mixed by means of well-known apparatus, for example a roll mill, a kneader, a Banbury mixer, a ball mill, a bead mill, an homogenizer, a paint shaker or a nanomizer.

The thickness of the elastomeric layer is preferably 0.5 mm or above, more preferably 1 mm or above, and especially 1–10 mm. The thickness of the cover layer is preferably 3 mm or below more preferably 2 mm or below and especially 20 μm–1 mm. The relatively thin cover layer does not damage the softness of the elastomeric layer.

The electrical resistance of the intermediate transfer member is preferably $10^1$–$10^{13}\Omega$ especially $10^2$–$10^{10}\Omega$. The electrical resistance of the outermost layer is preferably in the same range as that of the intermediate transfer member.

In order to adjust the electrical resistance of the intermediate transfer member, conductive material may be present in the elastic layer or in the cover layer. Examples of such conductive materials include conductive inorganic particles such as titanium oxide, tin oxide, barium sulphate, aluminium oxide, strontium titanate, magnesium oxide, silicon oxide, silicon carbide, silicon nitride, ionic conductive agents such as ammonium salts, alkyl sulphonates, phosphoric esters and perchlorates, conductive resins such as polymethyl methacrylate containing quaternary ammonium salts, polyvinyl aniline, polyvinyl pyrrole, polydiacetylene and polyethylene imine, and resins containing conductive particles. Conductive inorganic particles may be surfaced-treated with tin oxide, antimony oxide or carbon.

Examples of the resins which can be used in resin-containing conductive particles include urethanes, polyesters, vinyl acetate-vinylchloride copolymers and polymethylmethacrylate. In resins containing conductive particles, the conductive particles may be, for example, of carbon, aluminium or nickel. The conductive materials which can be used in the present invention are not limited to the above mentioned specific examples, but conductive inorganic particles are preferred from the standpoint of adjustment of conductivity.

The intermediate transfer member used in the present invention can be made as follows. A cylindrical metal support is first prepared, and rubber, elastomer or resin is formed into an elastic layer on the cylindrical support by melt moulding, injection moulding, dip coating or spray coating. Subsequently, a cover layer is formed on the elastomeric layer by a forming method described above if required.

A photosensitive member that is provided with a conductive support 107 and a protective layer (an outermost layer) 105 containing powdered fluorocarbon polymer on its photosensitive layer 106 is preferably used as a first image supporting member. An example of such a fluorocarbon polymer is polytetrafluoroethylene. Such a protective layer increases the efficiency of the first transfer member, and in particular its ability to transfer toner from the photosensitive member to the intermediate transfer member. As a result a high quality image can be formed which is relatively free from defects. Furthermore, the intermediate transfer member used in the present invention has good second transfer efficiency (i.e. the transfer efficiency from the intermediate transfer member to the second supporting member).

Examples of the second image supporting member used in the present invention include various kinds of paper and overhead projector (OHP) sheets.

The invention will now be described in more detailed with reference to the accompanying examples.

EXAMPLE 1

An intermediate transfer member was made as follows. A cylindrical aluminium support of external diameter 182 mm length 320 mm and thickness 5 mm was coated with an elastomeric layer of nitrile butadiene rubber (NBR) containing dispersed conductive carbon black. The elastomeric layer had a thickness of 5 mm. Then a coating liquid was prepared by mixing a 2-liquid-component polyester polyurethane resin, powdered silicone resin and conductive carbon black, which latter materials become dispersed in the polyester polyurethane resin. The resulting coating liquid was coated on the elastomeric layer by spray coating to form a cover layer which was hardened at 85° C. for two hours. The content of silicone resin in the resulting intermediate transfer member was 50% by weight of the cover layer. The contact angle and the sliding resistance of this intermediate transfer member are shown in table 1. The electrical resistance of the intermediate transfer member was measured under a range of environmental conditions including low temperature (15° C.) and low humidity (10% RH) conditions (hereinafter referred to as "LtLh conditions") and high temperature (32.5° C.) and high humidity (85% RH) conditions (hereinafter simply referred to as "HtHh conditions"). The outermost layer of the intermediate transfer member was held in contact with an aluminium plate (350 mm×200 mm). A voltage of 1 kV from a power supply was applied between the aluminium support of the intermediate transfer member and the aluminium plate. Then the potential difference between the ends of a 1 kΩ resistor was measured. The value of the electrical resistance of the intermediate transfer member was found from the voltage of the power supply, the potential difference across the 1 kΩ resistor and the resistance value of the 1 kΩ resistor.

Figure 1:
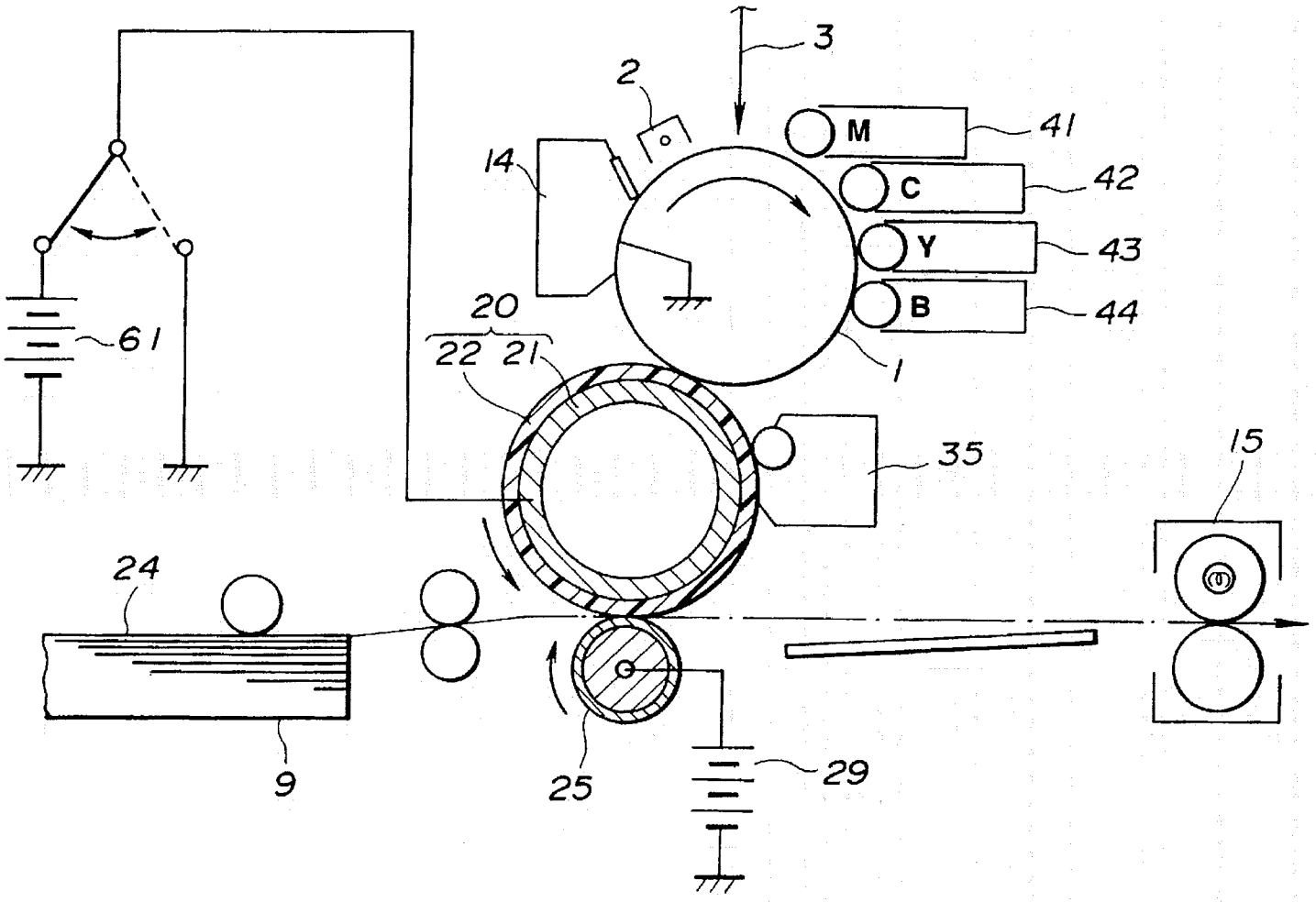
FIG. 1 is a diagrammatic side view of one embodiment of an image forming apparatus.

The intermediate transfer member was assembled into an electrophotographic copying machine as shown in FIG. 1. The machine was used to form colour images successively on 10,000 sheets (durability test) in this durability test, the transfer efficiency, the image quality and the toner filming were evaluated. The durability test was carried out under the following conditions. The first image supporting member was an OPC photosensitive member comprising a conductive support, an under-coat layer, a charge generating layer and a charge transport layer disposed in this order on the support. The dark part potential was −700V, the toner for all the colours used was a non-magnetic single component toner, the first transfer bias was +900V, the second transfer bias was +3400V, the process speed was 120 mm/sec, the developing bias was −500V and the second image supporting member had a weight of 80 g/m$^2$. The first transfer efficiency and the second transfer efficiency were calculated using the following equations in which image density is measured using a Macbeth reflection densitometer RD-918 manufactured by Macbeth Inc.

The first transfer efficiency={A/(B+A)}×100(%)

The second transfer efficiency={C/(D+C)}×100(%)

A: Density of a image on the intermediate transfer member.

B: Density of residual toner on the photosensitive member after an image has been transferred to the intermediate transfer member.

C: Density of an image on the second image supporting member.

D: Density of residual toner on the intermediate transfer member after an image has been transferred to the second image supporting member.

The densities were measured in the following manner. Images on the photosensitive member and on the intermediate transfer member were covered with adhesive tape. Then each adhesive tape was peeled off so that the respective image was transferred to the adhesive tape. The adhesive tape carrying the image was adhered to a piece of white paper to make a first sample. A second or reference sample was made which comprised a piece of white paper and adhesive tape adhered to it but not carrying an image. The densities A and B were ascertained by measuring the density of the first and second samples. The image quality and toner filming were evaluated visually. The toner filming is the toner filming on the intermediate transfer member. The results are shown in table 1, in which * means very good, O means good, Δ means usable, and x means unusable.

EXAMPLE 2

Coating liquid for the cover layer prepared in example 1 was applied to an endless PET belt containing conductive carbon black and hardened in the same way as in example 1 to form a belt-shaped intermediate transfer member. This intermediate transfer member was assembled into a colour electrophotographic machine as shown in FIG. 5 and the machine was evaluated in the same way as in example 1. The results are as shown in table 1.

EXAMPLE 3

A cylindrical aluminium support was coated with an elastomeric layer of silicone rubber containing conductive carbon black and methyl methacrylate (MMA) powder. The content of the methylmethacrylate resin powder was 20% by weight of the elastomeric layer. The resulting intermediate transfer member was assembled into a colour electrophotographic copying machine as shown in FIG. 1 and the machine was evaluated in the same way as in example 1. The results are shown in table 1.

EXAMPLE 4

An intermediate transfer member was prepared in the same way as in example 1 except that the coating liquid used for the cover layer was an acrylic-silicone resin containing lithium perchlorate. The resulting intermediate transfer member was assembled into a colour electrophotographic copying machine as shown in FIG. 1, and the machine was evaluated in the same way as in example 1 to give the results shown in table 1.

EXAMPLE 5

A colour electrophotographic copying machine was prepared in the same manner as in example 1 except that on the photosensitive layer there was a protective layer containing a fluorocarbon resin powder. The colour electrophotographic copying machine was evaluated in the same manner as in example 1 to give the results shown in table 1.

COMPARATIVE EXAMPLE 1

A colour electrophotographic copying machine was prepared in the same manner as in example 1 except that a two-liquid-component polyurethane resin containing a powdered silicone resin and conductive carbon black was used as the coating liquid for the cover layer, and except that hardening was carried out at 80° C. for one hour. The colour electrophotographic copying machine was evaluated in the same way as in example 1 to give the results shown in table 1.

COMPARATIVE EXAMPLE 2

A colour electrophotographic copying machine was prepared in the same manner as in example 1 except that styrene-acrylic resin and conductive carbon black was used as the coating liquid for the cover layer and except that the hardening was carried out at a 100° C. for one hour. The colour electrophotographic copying machine was evaluated in the same way as in example 1 to give the results shown in table 1.

COMPARATIVE EXAMPLE 3

A colour electrophotographic copying machine was prepared in same way as in example 1 except that a two-component liquid polyether polyurethane resin and conductive carbon black was used as the coating liquid for the cover layer and except that the hardening condition was 80° C. for one hour. The colour electrophotographic copying machine was evaluated in the same way as in example 1 to give the results shown in table 1.

COMPARATIVE EXAMPLE 4

A silicone rubber elastomeric layer containing carbon black was deposited on a cylindrical aluminium support to provide an intermediate transfer member. The resulting intermediate transfer member was assembled into a colour electrophotographic copying machine as shown in example 1, and the colour electrophotographic copying machine which was evaluated in the same way as in example 1 to give the results shown in table 1.

EXAMPLE 6

The rubber compound given below was applied onto a cylindrical aluminium support of external diameter 185 mm, length 320 mm and thickness 5 mm by transfer moulding to provide a roller having an elastomeric layer having thickness 5 mm.

| The Rubber Compound | |
|---|---|
| NBR | 100 parts |
| Zinc oxide | 2 parts |
| Conductive carbon black | 15 parts |
| Paraffin oil | 25 parts |
| Vulcanizing agent | 2 parts |
| Vulcanizing promoter | 3 parts |

A coating liquid containing the following ingredients was prepared.

| | |
|---|---|
| Polyurethane Prepolymer (including solvent) | 100 parts |
| Curing aqent (including solvent) | 50 parts |
| Lubricant: PTFE powder (average particle size 0.3 μm) | 100 parts |
| Dispersing agent | 5 parts |
| Conductive titanium oxide powder (average particle size 0.5 μm) | 10 parts |
| Toluene | 80 parts |

The coating liquid was applied onto the elastomeric layer by spray coating to provide a cover layer having a thickness of 80 μm, followed by heating for an hour at 90° C. to remove solvent from the cover layer and to bond the molecules of the cover layer. As a result, an intermediate transfer member having a strong cover layer was obtained. The content of PTFE powder was 60 weight % of the cover layer. The contact angle and sliding resistance of the resulting intermediate transfer member is shown in table 2. The electrical resistance of the intermediate transfer member was measured at a temperature of 23° C. and at 65% RH in the same way as in the example 1. Furthermore, the intermediate transfer member was assembled into a colour electrographic copying machine as shown in FIG. 1 which was used to form colour images on 10,000 sheets successively (durability test). In this durability test, transfer efficiency, image quality and toner-filming were evaluated by means of a test carried out under the following conditions. The first image supporting member was an OPC photosensitive member which comprised a conductive support, an undercoat layer, a charge generation layer, a charge transport layer and a protective layer containing PTFE powder disposed on the support in this order. The dark part potential was −750V, the toner for all colours was a non-magnetic mono-component toner, the first transfer bias was +1200V the second transfer bias was +5500V, the process speed was 120 mm/sec, the developing bias was −550V, the second image supporting member weighed 80 g/m$^2$, and only cyan toner was used when the transfer efficiency was measured. The intermediate transfer member was held in contact with an OPC photosensitive member which had no protective layer with contacting pressure of 1 kg at a temperature of 45° C. and 95% RH for two weeks (contact test). After two weeks, the surface of the intermediate transfer member was visually evaluated. The results are shown in table 2.

EXAMPLE 7

An intermediate transfer member was prepared in the same way as in example 6 except that the PTFE powder (content 60%, average particle size 0.3 μm) used in example 6 was changed to silicone resin powder (content 55%, average particle size 1.0 μm). The resulting intermediate transfer member was assembled into a colour electrophotographic copying machine as shown in FIG. 1, and the colour electrophotographic copying machine was evaluated in the same way as in example 6. The results are shown in table 2.

EXAMPLE 8

An intermediate transfer member was prepared in the same way as in example 6 except that the PTFE powder used in example 6 was changed to fluorinated graphite powder (content 60%, average particles 0.8 μm). The resulting intermediate transfer member was assembled into a colour electrophotographic copying machine as shown in FIG. 1, and the colour electrophotographic copying machine was evaluated in the same way as in example 6. The results are shown in table 2.

EXAMPLE 9

The intermediate transfer member of the invention was prepared in the same way as in example 6 except that PTFE powder used in example 6 was changed to MMA resin powder (content 40%, average particle size 1.5 μm). The resulting intermediate transfer member was assembled into a colour electrophotographic copying machine as shown in FIG. 1, which was evaluated in the same way as in example 6 to give the results shown in table 2.

EXAMPLE 10

An intermediate transfer member was prepared in the same way as in example 6 except that the PTFE powder used in example 6 was changed to silica powder (content 20%, average particle size 0.05 μm). The resulting intermediate transfer member was assembled into a colour electrophotographic copying machine as shown in FIG. 1, which was evaluated in the same manner as in example 6 to give the results shown in table 2.

EXAMPLE 11

An intermediate transfer member was prepared in the same way as in example 6 except that the PTFE powder used was changed to titanium dioxide powder (content 65%, average particle size 0.8 μm). The resulting intermediate member was assembled in to a colour electrophotographic copying machine as shown in FIG. 1, and the colour electrophotographic copying machine was evaluated in the same manner as in example 6. The results are shown in table 2.

EXAMPLE 12

An intermediate transfer member was prepared in the same manner as in example 6 except that the content of the PTFE powder used in example 6 was changed to 75%. The resulting intermediate member was assembled into a colour electrophotographic copying machine as shown in FIG. 1, and the colour electrophotographic copying machine was evaluated in the same manner as in example 6. After the durability test, a very small part of the outer layer of the intermediate transfer member had peeled off. However, the images produced did not deteriorate. The results are shown in table 2.

EXAMPLE 13

An intermediate transfer member was prepared in the same way as in example 6 except that the content of PTFE powder used in example 6 was changed to 20%. The resulting intermediate transfer member was assembled into a colour electrophotographic copying machine as shown in FIG. 1, which was evaluated as in example 6 to give the results shown in table 2.

EXAMPLE 14

An intermediate transfer member was prepared in the same way as in example 6 except that the rubber compound used in example 6 was changed to a two component liquid curable urethane elastomer containing PTFE powder (average particle size 0.3 μm) and carbon black. The curable urethane elastomer was cast at 120° C. and maintained at that temperature for two hours using a mould that had an aluminium cylindrical support in it. The content of PTFE powder and carbon black in the elastic layer were 30% and 10% respectively. The PTFE powder and carbon black were present in one liquid (i.e. the polyester polyol prepolymer) of the two-liquid component curable urethane elastomer before the two liquids were mixed. The resulting intermediate transfer member was assembled into a colour electrophotographic copying machine as shown in FIG. 1, which was evaluated in the same manner as in example 6 to give the results shown in table 2.

EXAMPLE 15

An endless belt of PET containing conductive carbon black was coated with the coating liquid for the cover layer prepared in example 6, which was hardened in the same manner as in example 6 to provide a belt-shaped intermediate transfer member which was evaluated in the same manner as in example 6 to give the result shown in table 2.

EXAMPLE 16

An intermediate transfer member was prepared as in example 6 except that the content of PTFE powder used in example 6 was changed to 85%. The resulting intermediate member was assembled into a colour electrophotographic copying machine as shown in FIG. 1, and the machine was evaluated as in example 6. After the durability test, a very small part of the outermost part of the intermediate transfer had peeled off. However, the images produced did not deteriorate. The results obtained are shown in table 2.

COMPARATIVE EXAMPLE 5

An intermediate transfer member was prepared in the same manner as in example 6 except PTFE powder was not used. The thus prepared intermediate transfer member was assembled in a colour electrophotographic copying machine as in FIG. 1, and the machine was evaluated as shown in example 6. The intermediate transfer member exhibited poor efficiency even at an early stage. After copying 10,000 sheets it failed to provide high image quality and sufficient durability. The results are shown in table 2.

COMPARATIVE EXAMPLE 6

An intermediate transfer member was prepared in the same way as in example 6 except that the content of PTFE powder used in example 6 was changed to 15%. The resulting intermediate transfer member was assembled into a colour electrophotographic copying machine as shown in FIG. 1 and this machine was evaluated as in example 6. The intermediate transfer member exhibited poor transfer efficiency at an early stage. After 10,000 sheets had been copied, it failed to provide images of high quality and sufficient durability. The results are shown in table 2.

COMPARATIVE EXAMPLE 7

An intermediate transfer member was prepared in the same way as in example 6 except that the PTFE powder (content 60%, average particle size 0.3 μm) used in example 6 was changed to silicone oil (content 20%). The result in intermediate transfer member was subjected to a contact test in the same way as in example 6. As a result, discolourations and small cracks were noticed on the surface of the photosensitive member. Therefore, a durability test was not carried out.

TABLE 1

| | CONTACT ANGLE (DEGREE) | SLIDING RESISTANCE (g) | THE FIRST TRANSFER EFFICIENCY (%) INITIAL | THE FIRST TRANSFER EFFICIENCY (%) AFTER $10^4$ SHEETS | THE SECOND TRANSFER EFFICIENCY (%) INITIAL | THE SECOND TRANSFER EFFICIENCY (%) AFTER $10^4$ SHEETS | IMAGE QUALITY | TONER FILMING | RESISTANCE (Ω) LtLh CONDITION | RESISTANCE (Ω) HtHh CONDITION |
|---|---|---|---|---|---|---|---|---|---|---|
| EXAMPLE 1 | 110 | 95 | 97 | 94 | 94 | 92 | * | * | $9.4 \times 10^6$ | $7.3 \times 10^6$ |
| EXAMPLE 2 | 110 | 95 | 95 | 92 | 95 | 92 | ○ | ○ | $3.0 \times 10^7$ | $9.8 \times 10^6$ |
| EXAMPLE 3 | 95 | 160 | 94 | 92 | 92 | 88 | Δ | ○ | $5.2 \times 10^6$ | $2.3 \times 10^6$ |
| EXAMPLE 4 | 90 | 190 | 94 | 90 | 90 | 82 | Δ | Δ | $5.4 \times 10^7$ | $9.3 \times 10^5$ |
| EXAMPLE 5 | 110 | 95 | 99 | 96 | 95 | 91 | * | ○ | $9.4 \times 10^6$ | $7.3 \times 10^5$ |
| COMP. EXAMPLE 1 | 80 | 240 | 81 | 80 | 79 | 73 | X | X | $2.4 \times 10^7$ | $5.3 \times 10^6$ |
| COMP. EXAMPLE 2 | 55 | 110 | 89 | 85 | 82 | 77 | Δ | X | $9.7 \times 10^6$ | $2.8 \times 10^6$ |
| COMP. EXAMPLE 3 | 53 | 280 | 85 | 81 | 65 | 64 | X | X | $1.8 \times 10^7$ | $8.9 \times 10^5$ |
| COMP. EXAMPLE 4 | 89 | 320 | 84 | 82 | 77 | 75 | X | X | $4.8 \times 10^6$ | $3.1 \times 10^6$ |

TABLE 2

| | CONTACT ANGLE (DEGREE) | SLIDING RESISTANCE (g) | RESISTANCE (Ω) | THE FIRST TRANSFER EFFICIENCY (%) INITIAL | THE FIRST TRANSFER EFFICIENCY (%) AFTER $10^4$ SHEETS | THE SECOND TRANSFER EFFICIENCY (%) INITIAL | THE SECOND TRANSFER EFFICIENCY (%) AFTER $10^4$ SHEETS | CONTACT TEST | IMAGE QUALITY | TONER FILMING |
|---|---|---|---|---|---|---|---|---|---|---|
| EXAMPLE 6 | 120 | 85 | $8.7 \times 10^7$ | 95 | 93 | 95 | 92 | * | * | * |
| EXAMPLE 7 | 115 | 95 | $8.0 \times 10^7$ | 94 | 91 | 93 | 90 | * | * | * |
| EXAMPLE 8 | 118 | 100 | $9.0 \times 10^7$ | 95 | 92 | 95 | 93 | * | * | * |
| EXAMPLE 9 | 95 | 117 | $6.1 \times 10^7$ | 95 | 91 | 91 | 88 | * | ○ | * |
| EXAMPLE 10 | 95 | 185 | $4.4 \times 10^7$ | 93 | 90 | 90 | 87 | * | ○ | ○ |
| EXAMPLE 11 | 90 | 98 | $8.1 \times 10^7$ | 93 | 89 | 90 | 87 | * | ○ | ○ |
| EXAMPLE 12 | 122 | 70 | $1.0 \times 10^8$ | 93 | 91 | 95 | 91 | * | * | * |
| EXAMPLE 13 | 89 | 165 | $4.0 \times 10^7$ | 95 | 91 | 89 | 85 | * | ○ | Δ |
| EXAMPLE 14 | 98 | 159 | $2.3 \times 10^7$ | 94 | 91 | 89 | 87 | ○ | ○ | Δ |
| EXAMPLE 15 | 120 | 85 | $1.2 \times 10^9$ | 90 | 87 | 92 | 89 | * | ○ | * |
| EXAMPLE 16 | 125 | 56 | $2.5 \times 10^8$ | 92 | 90 | 95 | 92 | * | Δ | Δ |
| COMP. EXAMPLE 5 | 58 | 265 | $2.0 \times 10^7$ | 89 | 81 | 78 | 72 | ○ | X | X |
| COMP. EXAMPLE 6 | 83 | 221 | $2.9 \times 10^7$ | 90 | 83 | 84 | 79 | ○ | Δ | X |
| COMP. EXAMPLE 7 | 105 | 210 | $3.8 \times 10^7$ | — | — | — | — | X | — | — |

We claim:

1. An image forming apparatus comprising:

a first image supporting member;

an intermediate transfer member for transferring thereto an image on said first image supporting member; and means for transferring the transferred image on said intermediate transfer member to a second image supporting member, wherein said intermediate transfer member has at least two layers, an outermost layer of said intermediate transfer member contains a lubricious powder, and the contact angle between the surface of said intermediate transfer member and water is 60° or above, and the sliding resistance of said surface is 200 g or below.

2. An apparatus according to claim 1, wherein the contact angle is 130° or below.

3. An apparatus according to claim 2, wherein the contact angle is 70° to 120°.

4. An apparatus according to claim 1, wherein the sliding resistance is 5 g or more.

5. An apparatus according to claim 4, wherein the sliding resistance is 10 g to 150 g.

6. An apparatus according to claim 1, wherein the content of the lubricious material in the outermost layer is 20% to 80% based on the weight of the outermost layer.

7. An apparatus according to claim 6, wherein the content of the lubricious material in the outermost layer is 25% to 75% based on the weight of the outermost layer.

8. An apparatus according to claim 1, wherein the electrical resistance of said intermediate transfer member is $10^1\Omega$ to $10^{13}\Omega$.

9. An apparatus according to claim 8, wherein the electrical resistance of said intermediate transfer member is $10^2\Omega$ $10^{10}\Omega$.

10. An apparatus according to claim 1, wherein said intermediate transfer member is cylindrical.

11. An apparatus according to claim 1, wherein said first image supporting member is an electrophotographic photosensitive member.

12. An apparatus according to claim 1, wherein an outermost layer of said electrophotographic photosensitive member contains particles of fluorocarbon polymer.

13. An apparatus according to claim 1, wherein said transferring means transfers a multi-colour image to said second image supporting member.

14. An apparatus according to claim 1, wherein said second image supporting member is a sheet of paper.

15. An apparatus according to claim 1, wherein said second image supporting member is an overhead projector sheet.

16. An apparatus according to claim 1, wherein said intermediate transfer member is an endless belt.

17. An apparatus according to claim 1, wherein said lubricious powder has an average particle size of 0.02–50 μm.

18. An intermediate transfer member for an electrophotographic image forming apparatus comprising:

a surface supporting means; and a surface supported by said surface supporting means, wherein said intermediate transfer member has at least two layers, an outermost layer of said intermediate transfer member contains a lubricious powder, and the contact angle between said surface and water is 60° or more, and the sliding resistance of the surface is 200 g or below.

19. A method for forming an image which comprises the steps of:

transferring a toner image from a first image supporting member to an intermediate transfer member;

transferring the toner image from said intermediate transfer member to a second image supporting member, wherein said intermediate transfer member has at least two layers, an outermost layer of said intermediate transfer member contains a lubricious powder, and the contact angle between the surface of said intermediate transfer member and water is 60° or above, and the sliding resistance of said surface is 200 g or below.

* * * * *

UNITED STATES PATENT AND TRADEMARK OFFICE

CERTIFICATE OF CORRECTION

PATENT NO. : 5,715,510
DATED : February 3, 1998
INVENTOR(S) : Takashi KUSABA, et al.

It is certified that error appears in the above-identified patent and that said Letters Patent is hereby corrected as shown below:

Title Page, [56] References Cited, second column, last entry:
delete "6167817" and insert therefor --6-167817--.

Column 4, line 4, after "5" delete the period (".") and insert therefor --; and--;
Line 47, delete "aluminium" and insert therefor --aluminum--;
Line 64, delete "on" and insert therefor --or--.

Column 5, line 6, delete "2-5" and insert therefor --2-5A--;
Line 12, delete "aluminium", both occurrences, and insert therefor --aluminum--.

Column 6, line 11, after "more", insert --of--;
Line 48, delete "minium" and insert therefor --minum--;
Line 63, delete "aluminium" and insert therefor --aluminum--.

Column 7, lines 31, 53, 55 and 56, delete "aluminium", each occurrence, and insert therefor --aluminum--.

Column 8, line 55, delete "aluminium" and insert therefor --aluminum--.

Column 9, lines 53 and 64, delete "aluminium", both occurrences, and insert therefor --aluminum--.

Column 12, line 6, delete "aluminium" and insert therefor --aluminum--.

UNITED STATES PATENT AND TRADEMARK OFFICE

CERTIFICATE OF CORRECTION

PATENT NO. : 5,715,510

DATED : February 3, 1998

INVENTOR(S) : Takashi KUSABA, et al.

It is certified that error appears in the above-indentified patent and that said Letters Patent is hereby corrected as shown below:

Column 16, line 11, after "member;", insert --and--.

Signed and Sealed this

Eleventh Day of August 1998

Bruce Lehman

*Attest:*

BRUCE LEHMAN

*Attesting Officer*

*Commissioner of Patents and Trademarks*